US011583006B2

(12) United States Patent
Wen

(10) Patent No.: US 11,583,006 B2
(45) Date of Patent: Feb. 21, 2023

(54) ATOMIZING DEVICE COMPRISING AIRFLOW PASSAGE WITH BENDING SECTION

(71) Applicant: SHENZHEN SMOORE TECHNOLOGY LIMITED, Shenzhen (CN)

(72) Inventor: Zhihua Wen, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 469 days.

(21) Appl. No.: 16/726,922

(22) Filed: Dec. 25, 2019

(65) Prior Publication Data

US 2020/0205476 A1 Jul. 2, 2020

(30) Foreign Application Priority Data

Dec. 26, 2018 (CN) ..... 201811604093.3

(51) Int. Cl.
*A24F 40/51* (2020.01)
*A24F 40/40* (2020.01)
*A24F 40/10* (2020.01)

(52) U.S. Cl.
CPC ..... *A24F 40/51* (2020.01); *A24F 40/10* (2020.01); *A24F 40/40* (2020.01)

(58) Field of Classification Search
CPC ..... A24F 40/51; A24F 40/40; A24F 40/10
See application file for complete search history.

(56) References Cited

U.S. PATENT DOCUMENTS

2003/0154991 A1 8/2003 Fournier et al.
2013/0319439 A1 12/2013 Gorelick et al.
2015/0272223 A1 10/2015 Weigensberg et al.
2019/0166913 A1* 6/2019 Trzecieski ..... A61M 15/06

FOREIGN PATENT DOCUMENTS

EP 3162229 5/2017
WO 2018184787 10/2018
WO WO-2020002924 A1 * 1/2020 ..... A24B 15/243

OTHER PUBLICATIONS

"Office Action of Europe Counterpart Application", dated May 31, 2021, p. 1-p. 5.
"Search Report of Europe Counterpart Application", dated Apr. 28, 2020, p. 1-p. 7.

* cited by examiner

*Primary Examiner* — Hae Moon Hyeon
(74) *Attorney, Agent, or Firm* — JCIP Global Inc.

(57) ABSTRACT

An atomizing device includes an atomizer, a puff sensor and an airflow passage. A transfer passage is defined in the atomizer, and two end portions of the airflow passage are respectively fluidly communicated with the transfer passage and the puff sensor. The airflow passage comprises a bending section, which is configured to prevent liquid in the atomizer from flowing to the puff sensor. With the bending section, liquid is difficult to reach the puff sensor even if it flows into the main body, therefore the safety and the service life of the atomizing device are improved.

10 Claims, 7 Drawing Sheets

ATOMIZING DEVICE COMPRISING AIRFLOW PASSAGE WITH BENDING SECTION

CROSS-REFERENCE TO RELATED APPLICATION

This present invention claims the priority benefit of China application serial no. 201811604093.3, filed on Dec. 26, 2018. The entirety of the above-mentioned patent application is hereby incorporated by reference herein and made a part of this specification.

BACKGROUND

Technical Field

The present invention relates to the technical field of atomization, and specifically to an atomizing device.

Description of Related Art

An atomizing device mainly includes an atomizer for atomizing liquid and a main body for supplying power to the atomizer. There are two conventional ways to start the atomizing devices. Wherein, one way is to start by pressing a button, and another way is to start by a user's drawing operation sensed by a puff sensor.

The puff sensor in the conventional atomizing device is generally disposed in the main body. The atomizer generally includes a suction nozzle end away from the main body and an air inlet end proximate to the main body. An air inlet is defined in the air inlet end.

The puff sensor in the main body is fluidly communicated with the air inlet to sense user's drawing operation. The liquid in the atomizer likely flow to the puff sensor when leaking out through the air inlet, causing the puff sensor to fail, and the main body is scrapped.

SUMMARY

The technical solution adopted by the invention to solve the technical problem is to construct an atomizing device comprising an atomizer, a puff sensor and an airflow passage. A transfer passage is defined in the atomizer, and two end portions of the airflow passage are respectively fluidly communicated with the transfer passage and the puff sensor. The airflow passage comprises a bending section, which is configured to prevent liquid in the atomizer from flowing to the puff sensor.

Preferably, the airflow passage comprises a first segment, a second segment and a third segment which are sequentially and fluidly connected. Each adjacent two segments of the first segment, the second segment and the third segment are arranged at an angle. One end portion of the first segment is fluidly communicated with the transfer passage, and one end portion of the third segment is fluidly communicated with the puff sensor. Two end portions of the second segment are respectively fluidly communicated with the other end portion of the first segment which is away from the atomizer and the other end portion of the third segment which is away from the puff sensor.

Preferably, the extending direction of the first segment is parallel to that of the third segment. The atomizing device further comprises a suction nozzle arranged at an end of the transfer passage which is away from the first segment. The puff sensor is arranged at an end of the third segment which is proximate to the suction nozzle. The two end portions of the second segment are respectively fluidly communicated with the other end portion of the first segment which is away from the suction nozzle, and the other end portion of the third segment which is away from the suction nozzle.

Preferably, the atomizing device further comprises a main body, wherein the main body comprises a battery holder and a guiding member arranged on the battery holder. The first segment and the third segment are defined in the battery holder, and a strip-shaped guide recess is defined on a surface of the guiding member. The surface of the guiding member on which the guide recess is defined is attached to a surface of the battery holder, and thus the second segment is defined between the guiding member and the battery holder.

Preferably, the battery holder is provided with a clamping groove for clamping the guiding member.

Preferably, a receiving recess is defined on an end surface of an end portion of the airflow passage which faces the transfer passage. A flange protruding from a bottom surface of the receiving recess is provided around a periphery of the end portion of the airflow passage.

Preferably, the atomizing device further comprises a first sealing member. The first sealing member is disposed at an end of the airflow passage which is adjacent to the transfer passage, and abuts against an outer surface of the atomizer. The receiving recess is defined on one side of the first sealing member which faces the transfer passage, and the flange extends through the first sealing member.

Preferably, the puff sensor is arranged on the main body.

Preferably, the main body comprises an inner housing and a mounting base detachably arranged on the inner housing, the mounting base defines a mounting position for mounting the puff sensor, and the mounting base further defines a vent for enabling the puff sensor to be fluidly communicated with the airflow passage.

Preferably, the puff sensor is a microphone.

The atomizing device of the invention has the following beneficial effects. With the bending section, liquid is difficult to reach the puff sensor even if it flows into the main body, therefore the safety and the service life of the atomizing device are improved.

To make the aforementioned more comprehensible, several embodiments accompanied with drawings are described in detail as follows.

BRIEF DESCRIPTION OF THE DRAWINGS

The present invention will now be further described with reference to the accompanying drawings and embodiments.

DESCRIPTION OF THE EMBODIMENTS

Figure 1:
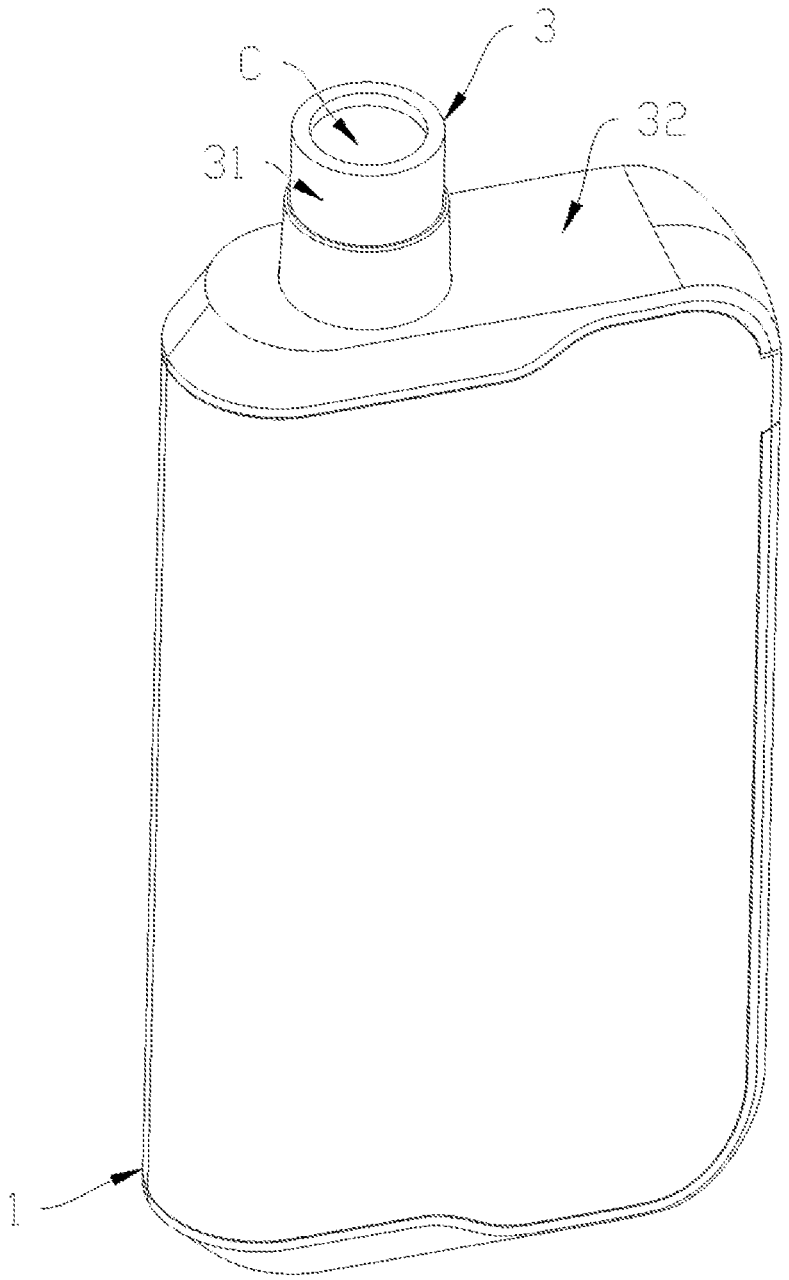
FIG. 1 is a schematic structural diagram of an atomizing device according to an embodiment of the present invention.
Figure 2:
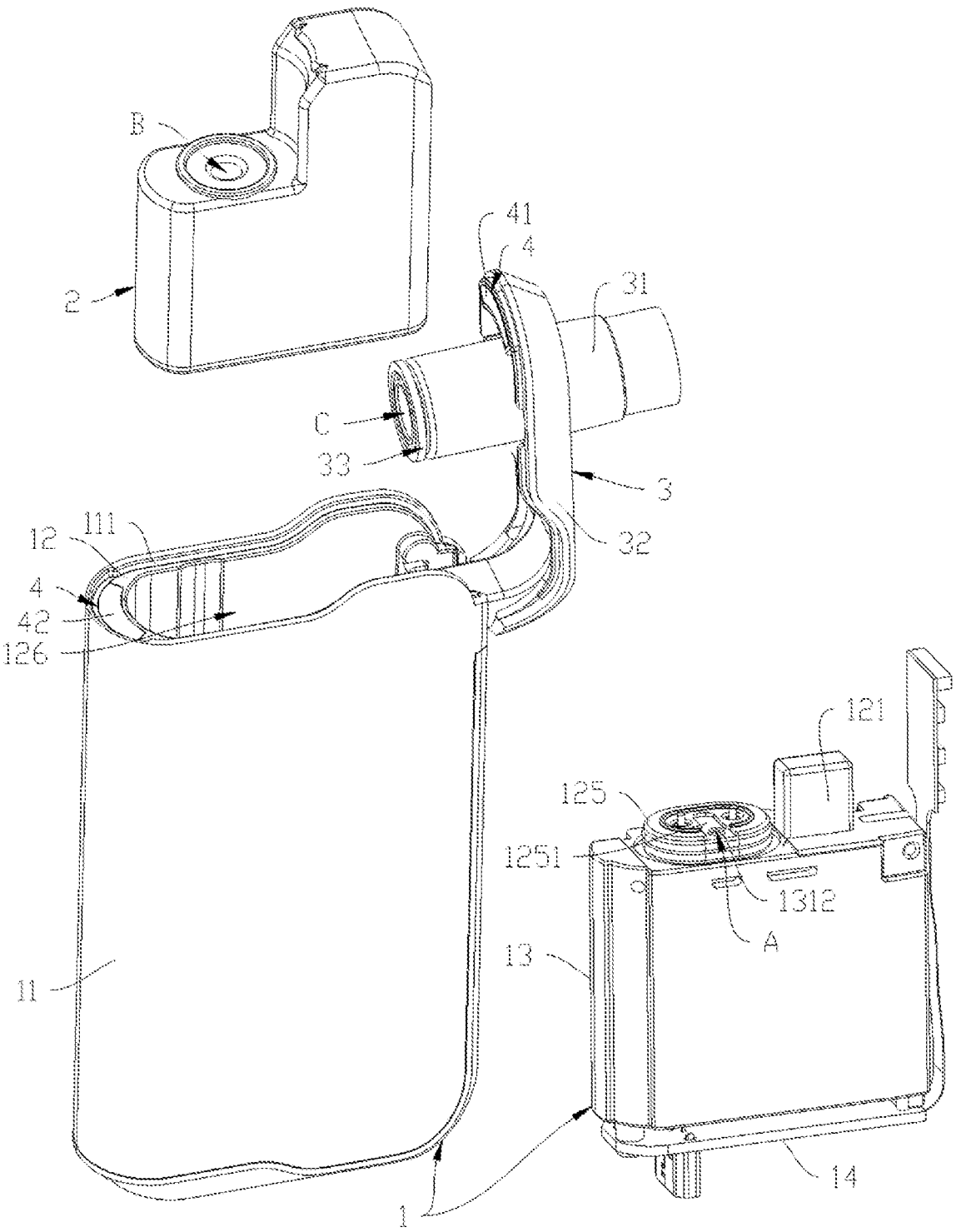
FIG. 2 is an exploded structural diagram of the atomizing device of FIG. 1.
Figure 3:
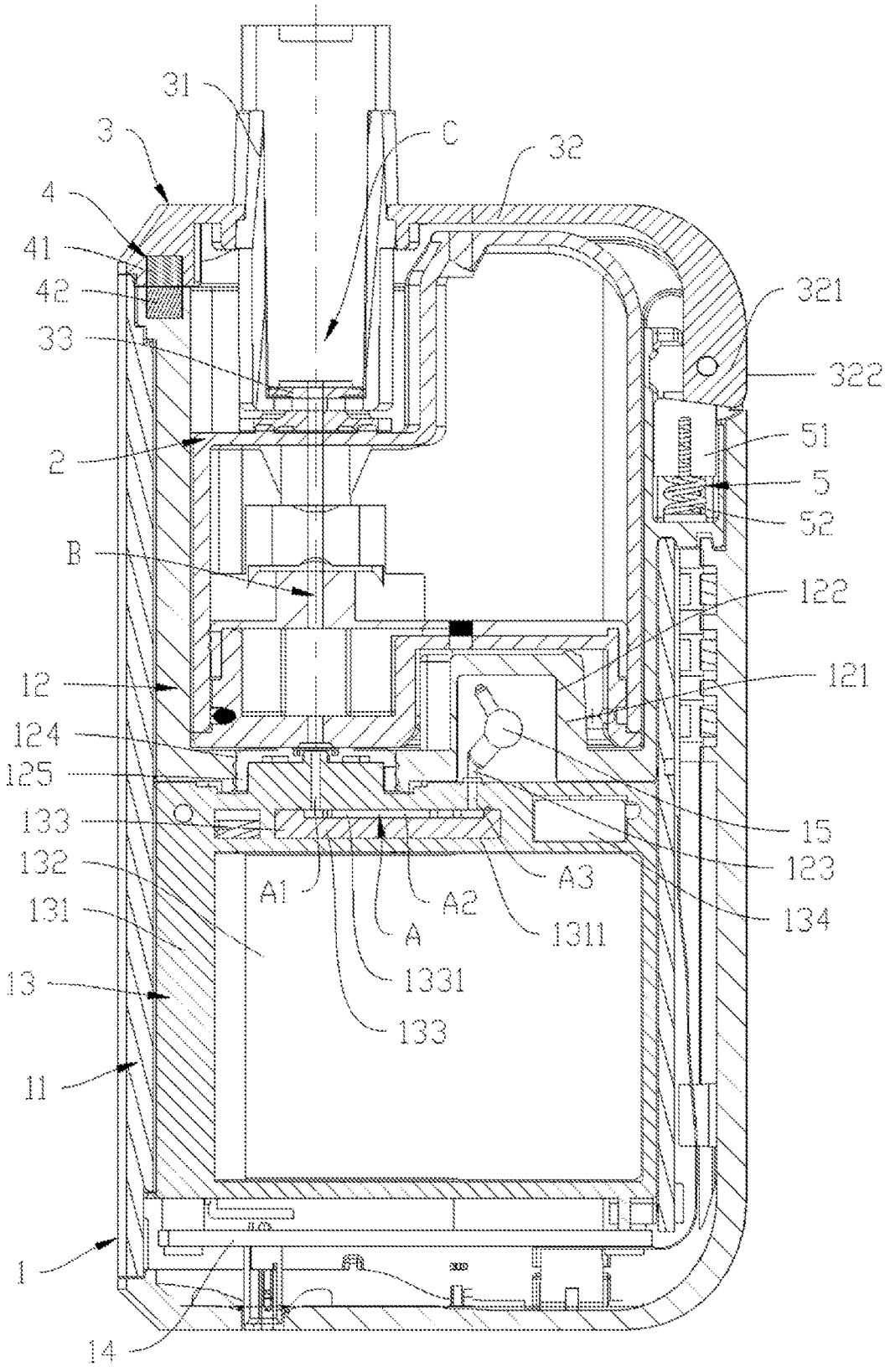
FIG. 3 is a cross-segmental structural diagram of the atomizing device of FIG. 1 when a suction nozzle assembly is closed.
Figure 4:
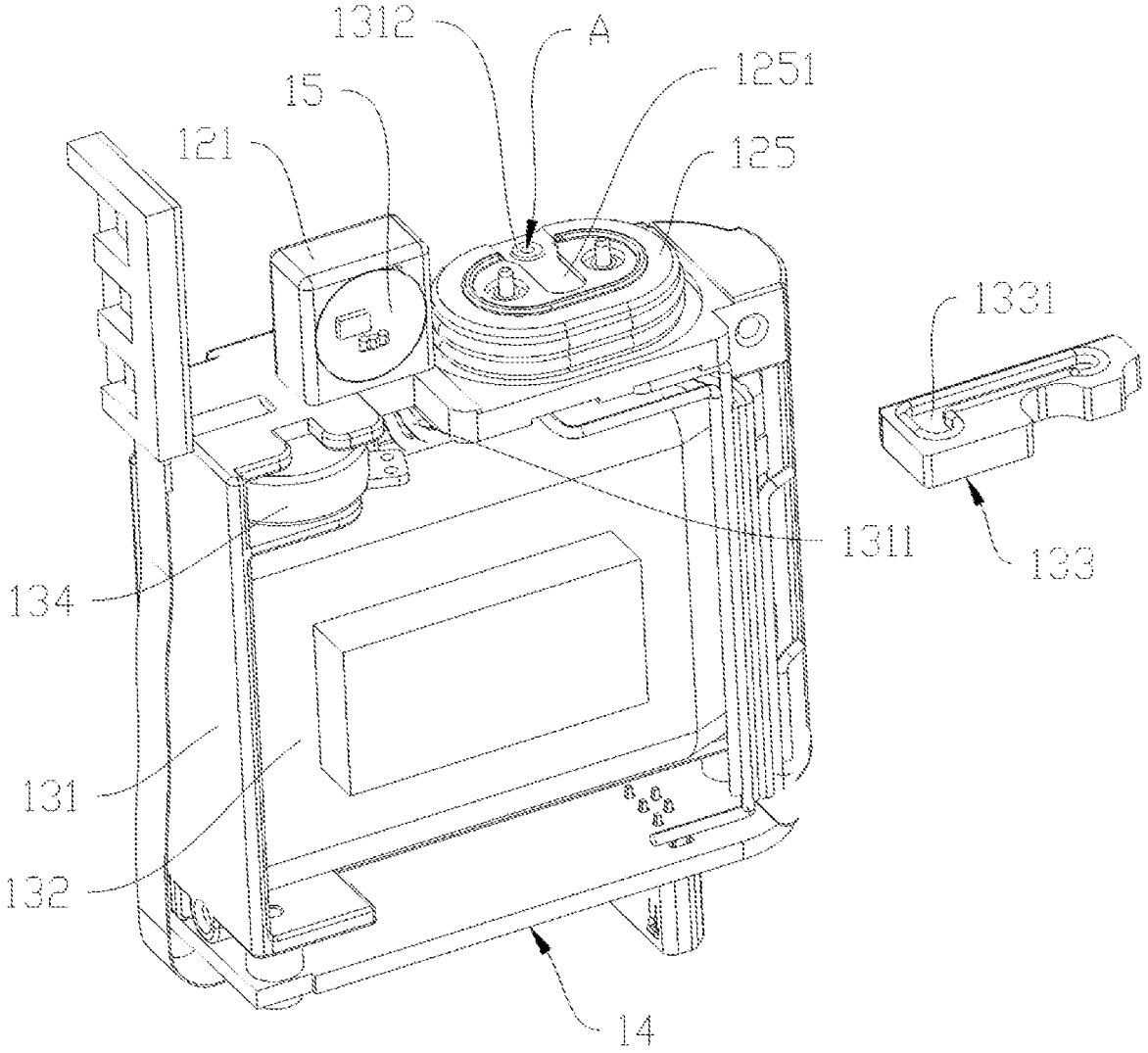
FIG. 4 is an assembly diagram of a battery assembly, a puff sensor and a first sealing member of the atomizing device of FIG. 2 from another perspective.

In order to render a more apparent understanding of technical features, objects, and effects of the present invention, specific embodiments thereof will be described in detail with reference to the accompanying drawings.

As shown in FIG. 1 to FIG. 4, an atomizing device in an embodiment of the present invention includes a main body 1, an atomizer 2, and a suction nozzle assembly 3.

The main body 1 includes an outer housing 11, an inner housing 12, a battery assembly 13, and a control circuit board 14. The inner housing 12, the battery assembly 13, and the control circuit board 14 are disposed in the outer housing 11. An opening 111 is defined at one end of the outer housing 11. The battery assembly 13 is provided at a bottom of the outer housing 11 opposite to the opening 111.

The inner housing 12 is positioned in the outer housing 11 and abuts against the battery assembly 13, to retain the battery assembly 13 to the bottom of the outer housing 11. A receiving cavity 126 fluidly communicated with one end of the opening 111 of the outer housing 11 is defined in the inner housing 12. One end of the receiving cavity 126 toward the main body 1 is recessed. The atomizer 2 is mounted in the receiving cavity 126 via the opening 111.

A puff sensor 15 is set in the inner housing 12. The puff sensor 15 is fluidly communicated with an airflow passage A in the battery assembly 13 when the inner housing 12 and the battery assembly 13 are assembled in the outer housing 11. Preferably, a mounting base 121 is detachably arranged on the inner housing 12, and the mounting base 121 defines a mounting position 122 for mounting the puff sensor 15. The mounting base 121 further defines a vent 123 for enabling the puff sensor 15 to be fluidly communicated with the airflow passage A.

The battery assembly 13 includes a battery holder 131, a battery 132, a guiding member 133 and a motor 134. The battery 132, the guiding member 133 and the motor 134 are disposed on the battery holder 131. The control circuit board 14 is disposed outside the battery holder 131 and electrically connected to the battery 132.

An airflow passage A is defined in the battery assembly 13 to allow air to flow into the atomizer 2. A transfer passage B is defined in the atomizer 2. Two end portions of the airflow passage A are respectively fluidly communicated with the transfer passage B and the puff sensor 15. The airflow passage A includes a bending section, which is configured to prevent liquid in the atomizer 2 from flowing to the puff sensor 15.

The puff sensor 15 is electrically connected with the control circuit board 14. When the puff sensor 15 senses air flows, the control circuit board 14 controls the battery assembly 13 to supply power to the atomizer 2 to atomize the liquid.

With the bending section, liquid is difficult to reach the puff sensor 15, even if it flows into the main body 1. Therefore, the safety and the service life of the battery assembly 13 and the puff sensor 15 are improved.

In the embodiment, the airflow passage A includes a first segment A1, a second segment A2, and a third segment A3, which are sequentially and fluidly connected. Each adjacent two segments of the first segment A1, the second segment A2 and the third segment A3 are arranged at an angle. One end portion of the first segment A1 is fluidly communicate with the transfer passage B, and one end portion of the third segment A3 is fluidly communicate with the puff sensor 15.

Two end portions of the second segment A2 are respectively fluidly communicated with the other end portion of the first segment A1 which is away from the atomizer 2, and the other end portion of the third segment A3 which is away from the puff sensor 15. The airflow passage A has multiple segments, and there are angles formed between each two adjacent segments. Therefore, liquid can be prevented from flowing from the atomizer 2 to the puff sensor 15 via the airflow passage A.

In some embodiments, the bending section may include two segments arranged at an acute angle. In other embodiments, the bending section may include more than three segments which are sequentially and fluidly communicated, and each adjacent two segments are arranged at an angle.

Preferably, the extending direction of the first segment A1 is parallel to that of the third segment A3. The suction nozzle 31 of the suction nozzle assembly 3 is located at one end of the transfer passage B which is away from the first segment A1. The puff sensor 15 is located at one end of the third segment A3 which is proximate to the suction nozzle 31.

Furthermore, the two end portions of the second segment A2 are respectively fluidly communicated with the other end portion of the first segment A1 which is away from the suction nozzle 31, and the other end portion of the third segment A3 which is away from the suction nozzle 31. When a relatively large amount of liquid flows into the airflow passage A, the second segment A2 is able to receive some liquid, to reduce the possibility of the liquid overflowing to the puff sensor 15. When a relatively small amount of liquid flows into the airflow passage A, the inner wall of the airflow passage A is able to adsorb the liquid.

In other embodiments, an extending direction of the first segment A1 is parallel to that of the third segment A3, and the two end portions of the second segment A2 are respectively fluidly communicated with the other end portion of the first segment A1 which is away from the suction nozzle 31 and one end portion of the third segment A3 which is proximate to the suction nozzle 31. The puff sensor 15 is located at the end of the third segment A3 which is away from the suction nozzle 31. Therefore, the possibility of the liquid flowing from the atomizer 2 to the puff sensor 15 via the airflow passage A is reduced.

In some embodiments, the first segment A1 and the third segment A3 are defined in the battery holder 131. A strip-shaped guide recess 1331 is defined on a surface of the guiding member 133. The surface of the guiding member 133 on which the guide recess 1331 is defined is attached to a surface of the battery holder 131. Therefore, the second segment A2 is defined between the guiding member 133 and the battery holder 131. As the second segment A2 is able to be achieved by the two parts attached to each other, the processing difficulty of the second segment A2 can be reduced.

In order to facilitate the retaining of the battery holder 131, the battery holder 131 is provided with a clamping groove 1311 for clamping the guiding member 133. With the guiding member 133 clamped, the retaining stability of the guiding member 133 can be improved, and the possibility of the airflow leakage of the second segment A2 can be reduced.

A hole 124 fluidly communicated with the transfer passage B is defined in the inner housing 12 at a position adjacent to the transfer passage B. A first sealing member 125 is disposed in the hole 124. The first sealing member 125 is disposed around an end portion of the airflow passage A which is adjacent to the transfer passage B, and abuts against an outer surface of the atomizer 2. Therefore, an outer periphery of the transfer passage B is sealed by the first sealing member 125.

A receiving recess 1251 is defined on one side of the first sealing member 125 which faces the transfer passage B. The receiving recess 1251 is able to receive at least a portion of liquid leaked from the atomizer 2.

Furthermore, in order to prevent the received liquid by the receiving recess 1251 from flowing into the airflow passage A, a flange 1312 is provided around a periphery of the end portion of the airflow passage A. The flange 1312 protrudes from a bottom surface of the accommodating recess 1251, and extends through the first sealing member 125.

In other embodiments, when sealing of connection surfaces of the transfer passage B and the airflow passage A is ensured, the receiving recess 1251 may be defined on an end surface of the airflow passage A which faces the transfer passage B.

As shown in FIG. 2 to FIG. 6, the suction nozzle assembly 3 in some embodiments includes a cover 32 that covers the opening 111 of the receiving cavity 126 and a suction nozzle 31 disposed on the cover 32. The cover 32 is rotatably connected to the main body 1, such that the cover 32 is able to switch between an open position and a closed position relative to the main body 1. When the cover 32 is at the open position, the receiving cavity 126 is opened to access the atomizer 2. When the cover 32 is at the closed position, the receiving cavity 126 is closed with the atomizer 2 covered by the cover 32.

An outlet passage C is defined in the suction nozzle 31. The outlet passage C is fluidly communicated with the transfer passage B of the atomizer 2 when the cover 32 is at the closed position, such that aerosol atomized in the atomizer 2 can be carried to the suction nozzle 31 when air flows. A flavor ball capable of releasing smell is provided in the suction nozzle assembly 3, such that different flavors for customers can be achieved.

The atomizer 2 is received in the main body 1, and is retained by the cover 32 when the cover 32 is at the closed position. Therefore, a simpler and more stable construction can be achieved, and the atomizer 2 is facilitated to be replaced and accessed. The main body 1 can be recyclable, thereby reducing the costs and improving the service life. And a more beautiful and refined appearance of the main body 1 can be achieved to meet the aesthetic requirement of users.

The suction nozzle assembly 3 abuts against the atomizer 2 to retain the atomizer 2 in the receiving cavity 126 when the cover 32 is at the closed position. Two adjacent surfaces of the atomizer 2 and the main body 1 are respectively provided with electrodes. The electrodes are used to electrically connect the atomizer 2 and the main body 1. Bad contacts between the electrodes can be avoided by the pressure applied to the atomizer 2 by the cover 32.

Preferably, a first positioning mechanism 4 is provided between the suction nozzle assembly 3 and the main body 1. The first positioning mechanism 4 is used to keep the suction nozzle assembly 3 at the closed position. The first positioning mechanism 4 includes a first adsorbing member 41 and a second adsorbing member 42 which can adsorb each other. The first adsorbing member 41 and the second adsorbing member 42 are respectively arranged on the suction nozzle 31 and the main body 1, and are adjacent to each other.

One of the first adsorbing member 41 and the second adsorbing member 42 is a magnet, the other one of the first adsorbing member 41 and the second adsorbing member 42 can be a magnet or a metal member capable of being adsorbed by the magnet. The cover 32 is kept at the closed position when the first adsorbing member 41 and the second adsorbing member 42 are adsorbed to each other. In other embodiments, the first positioning mechanism 4 may also be snap-fit structures that snap into each other.

Furthermore, the main body 1 is further provided with a second positioning mechanism 5. The second positioning mechanism 5 is used to keep the suction nozzle assembly 3 at the open position. In this embodiment, the second positioning mechanism 5 includes a retaining member 51 and an elastic member 52 arranged on the main body 1.

The cover 32 is provided with a resisting portion 321. The elastic member 52 provides an elastic force for allowing the retaining member 51 to abut against the resisting portion 321 to maintain the cover 32 at the open position.

Preferably, the elastic force applied by the elastic member 52 is perpendicular to a rotation axis of the cover 32. The resisting portion 321 is provided with an abutting surface 322 against which the retaining member 51 abuts. The abutting surface 322 is a plane parallel to the rotation axis of the cover 32. In other embodiments, the resisting portion 321 may be a protrusion or a location hole extending in the direction of the rotation axis of the cover 32. The cover 32 is kept at the open position when the retaining member 51 is snapped to the protrusion or the location hole.

One end portion of the outlet passage C which faces the transfer passage B is provided with a second sealing member 33. The second sealing member 33 is used to seal connection surfaces of the outlet passage C and the transfer passage B. Therefore, a periphery of the end portion of the outlet passage C is sealed by the second sealing member 33 when the cover 32 is at the closed position.

Figure 5:
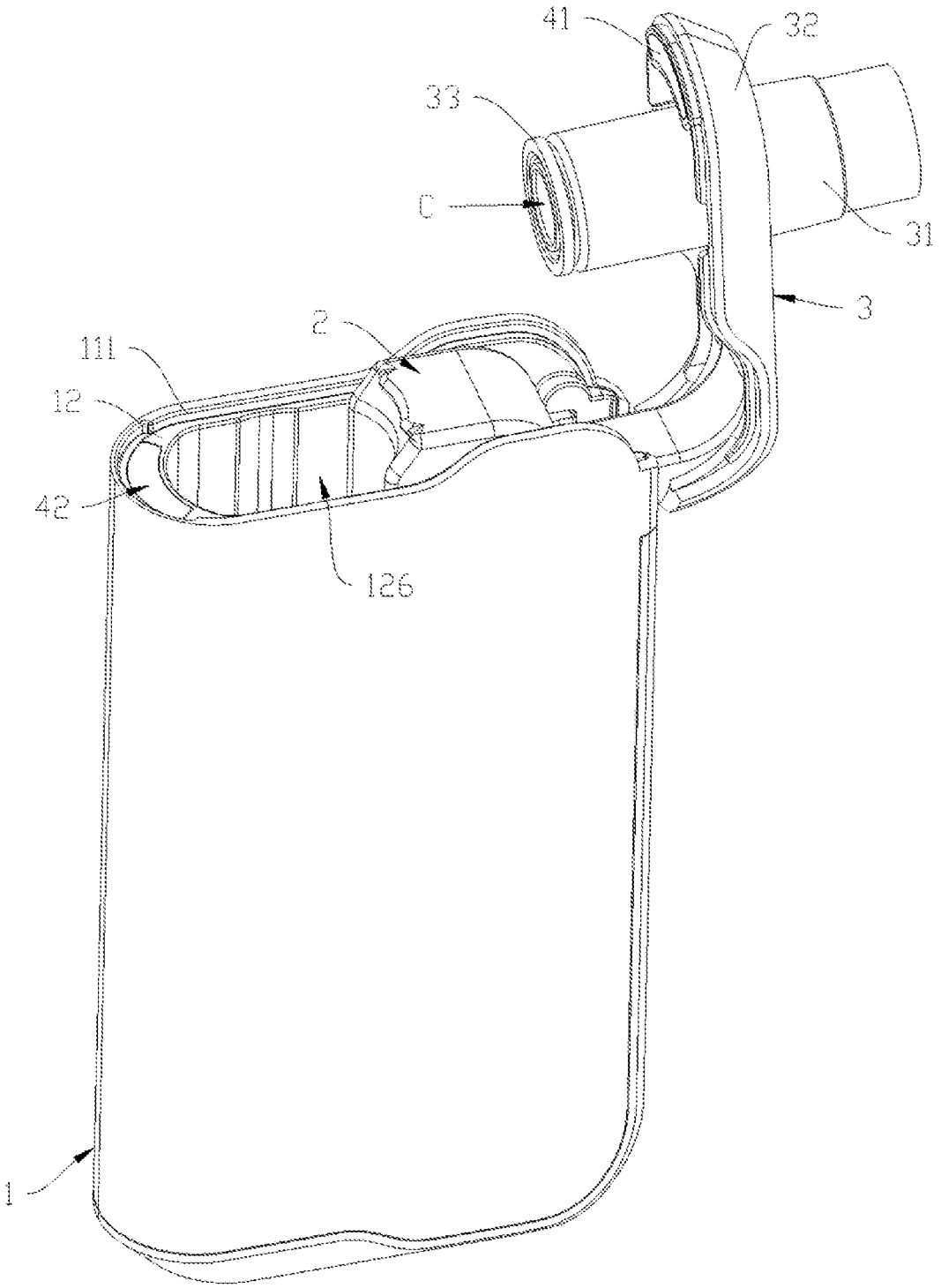
FIG. 5 is a schematic structural diagram of the atomizing device of FIG. 1 when the suction nozzle assembly is open.
Figure 6:
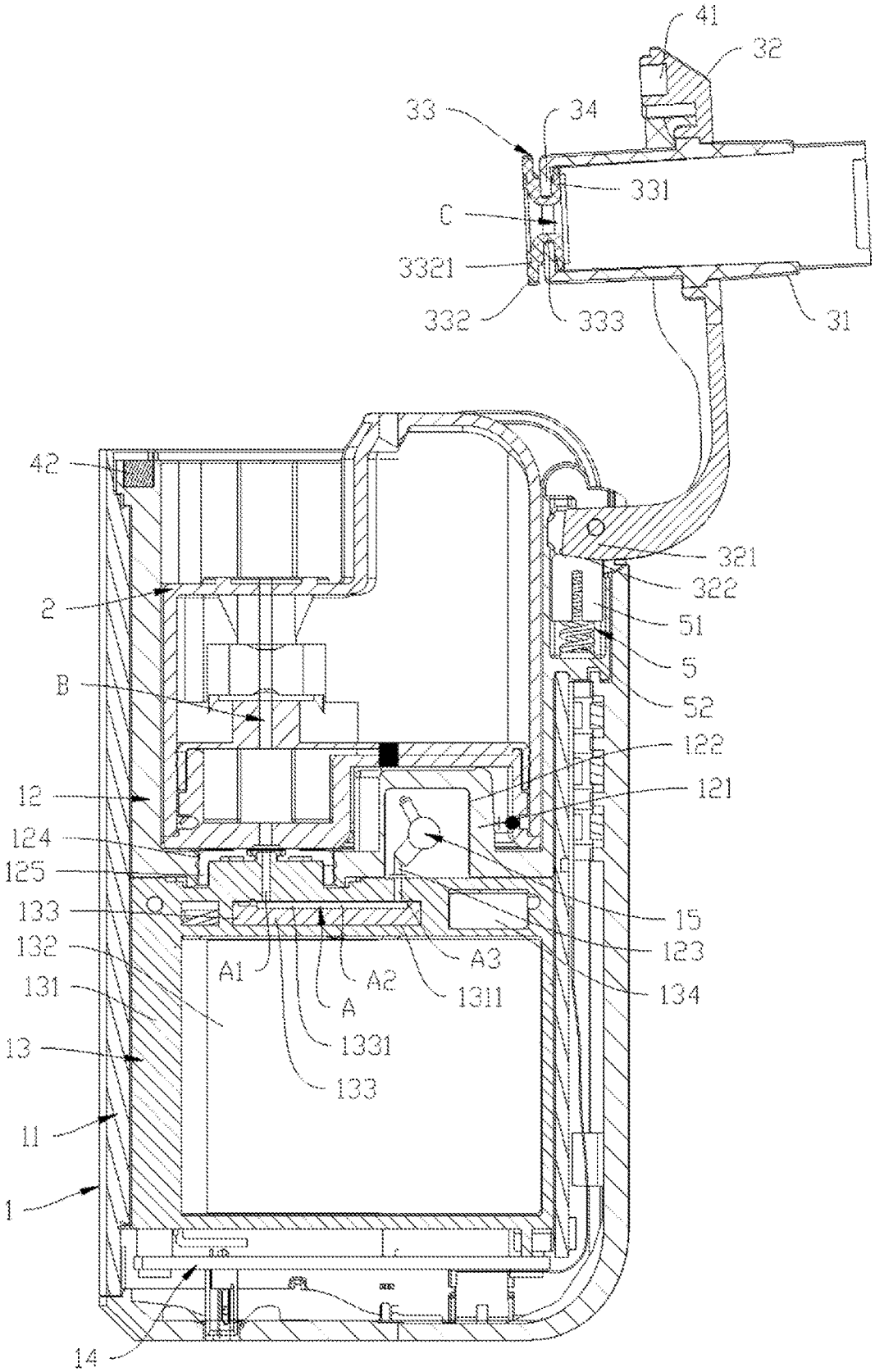
FIG. 6 is a cross-segmental structural diagram of the atomizing device of FIG. 5 when the suction nozzle assembly is closed.
Figure 7:
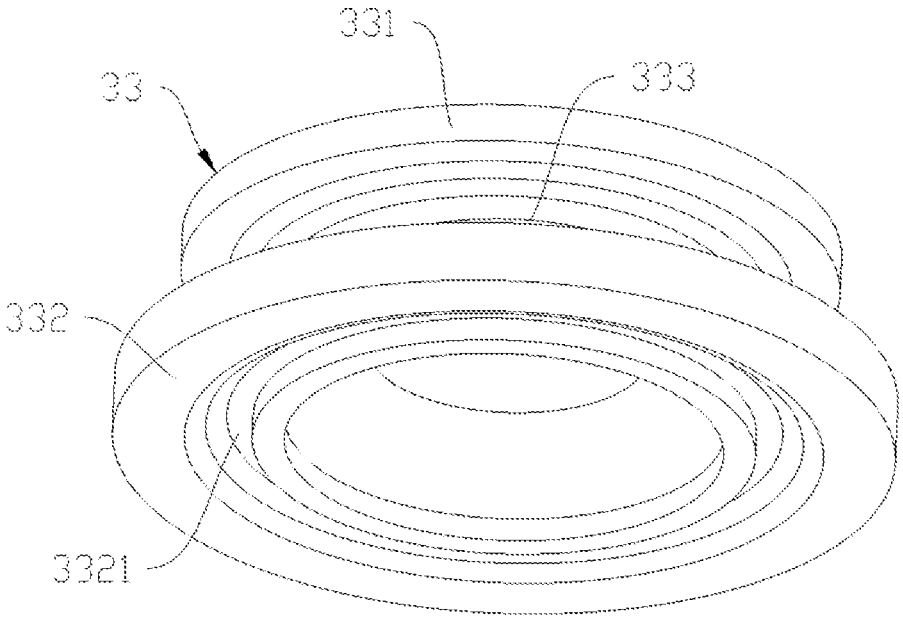
FIG. 7 is a schematic structural diagram of a second sealing member of the suction nozzle assembly of FIG. 5.

As shown in FIGS. 5 to 7, the second sealing member 33 is made of a soft material preferably. An annular groove 3321 along a circumferential direction of the outlet passage C is defined on a surface of the second sealing member 33 which faces the atomizer 2.

In this embodiment, the second sealing member 33 includes an annular first sealing portion 331 and an annular second sealing portion 332. The first sealing portion 331 and the second sealing portion 332 are spaced along an axial direction of the second sealing member 33. A tubular connecting portion 333 is provided to connect an inner periphery of the first sealing portion 331 and that of the second sealing portion 332. An annular retaining portion 34 is arranged in an inner periphery of an end of the outlet passage C which faces the transfer passage B. The connecting portion 333 extends through an inner hole of the retaining portion 34. The first sealing portion 331 and the second sealing portion 332 are respectively arranged on two sides of the retaining portion 34.

The second sealing portion 332 is located at one end proximate to the transfer passage B. The annular recess 3321 is defined on a surface of the second sealing ring 332 which faces the transfer passage B. As the recess 3321 is defined on a surface of the soft second sealing portion 332, the second sealing portion 332 with the recess 3321 can act as a sucking disc to attach to a surface of the atomizer 2 when being pressed, so as to improve the sealing effect.

It is to be understood that the above-mentioned technical features can be used in any combination without limitation.

The above description is merely exemplary of the invention, and is not intended to limit the scope of the invention; the equivalent structure or equivalent process transformation on the basis of the present invention and of the drawings may be directly or indirectly applied to other related technical fields and shall all fall within the scope of the present invention.

What is claimed is:

1. An atomizing device, comprising an atomizer, and a puff sensor, wherein a transfer passage is defined in the atomizer, and two end portions of an airflow passage are respectively fluidly communicated with the transfer passage and the puff sensor; and the atomizing device further comprises:

a main body, wherein the main body comprises a battery holder and a guiding member arranged on the battery holder; and the airflow passage, comprising a first segment, a second segment and a third segment, wherein the first segment and the third segment are defined in the battery holder, and a strip-shaped guide recess is defined on a surface of the guiding member; the surface of the guiding member on which the guide recess is defined is attached to a surface of the battery holder, and thus the second segment is defined between the guiding member and the battery holder;

the first segment, the second segment and the third segment are sequentially and fluidly connected, wherein each adjacent two segments of the first segment, the second segment and the third segment are arranged at an angle, one end portion of the first segment is fluidly communicated with the transfer passage, and one end portion of the third segment is fluidly communicated with the puff sensor; and two end portions of the second segment are respectively fluidly communicated with the other end portion of the first segment which is away from the atomizer and the other end portion of the third segment which is away from the puff sensor.

2. The atomizing device according to claim 1, wherein an extending direction of the first segment is parallel to that of the third segment; the atomizing device further comprises a suction nozzle arranged at an end of the transfer passage which is away from the first segment; the puff sensor is arranged at an end of the third segment which is proximate to the suction nozzle; and the two end portions of the second segment are respectively fluidly communicated with the other end portion of the first segment which is away from the suction nozzle, and the other end portion of the third segment which is away from the suction nozzle.

3. The atomizing device according to claim 2, wherein a receiving recess is defined on an end surface of an end portion of the airflow passage which faces the transfer passage; and a flange protruding from a bottom surface of the receiving recess is provided around a periphery of the end portion of the airflow passage.

4. The atomizing device according to claim 3, wherein the atomizing device further comprises a first sealing member disposed at an end of the airflow passage which is adjacent to the transfer passage, and abuts against an outer surface of the atomizer; and the receiving recess is defined on one side of the first sealing member which faces the transfer passage, and the flange extends through the first sealing member.

5. The atomizing device according to claim 1, wherein the battery holder is provided with a clamping groove for clamping the guiding member.

6. The atomizing device according to claim 5, wherein a receiving recess is defined on an end surface of an end portion of the airflow passage which faces the transfer passage; and a flange protruding from a bottom surface of the receiving recess is provided around a periphery of the end portion of the airflow passage.

7. The atomizing device according to claim 6, wherein the atomizing device further comprises a first sealing member disposed at an end of the airflow passage which is adjacent to the transfer passage, and abuts against an outer surface of the atomizer; and the receiving recess is defined on one side of the first sealing member which faces the transfer passage, and the flange extends through the first sealing member.

8. The atomizing device according to claim 5, wherein the puff sensor is arranged on the main body.

9. The atomizing device according to claim 8, wherein the main body comprises an inner housing and a mounting base detachably arranged on the inner housing; the mounting base defines a mounting position for mounting the puff sensor, and further defines a vent for enabling the puff sensor to be fluidly communicated with the airflow passage.

10. The atomizing device according to claim 1, wherein the puff sensor is a microphone.

* * * * *